US007726597B2

(12) United States Patent
Bentley

(10) Patent No.: US 7,726,597 B2
(45) Date of Patent: Jun. 1, 2010

(54) VERTICAL SHAFT IMPACTOR ROCK CRUSHER

(75) Inventor: Neil Douglas Bentley, Edmonton (CA)

(73) Assignee: Amsco Cast Products (Canada) Inc., Edmonton, Alberta (CA)

( * ) Notice: Subject to any disclaimer, the term of this patent is extended or adjusted under 35 U.S.C. 154(b) by 165 days.

(21) Appl. No.: 12/002,817

(22) Filed: Dec. 19, 2007

(65) Prior Publication Data

US 2008/0191077 A1 Aug. 14, 2008

(30) Foreign Application Priority Data

Feb. 14, 2007 (CA) ..... 2578495

(51) Int. Cl.

| | |
|---|---|
| ***B02C 7/00*** | (2006.01) |
| ***B02C 7/12*** | (2006.01) |
| ***B02C 17/20*** | (2006.01) |
| ***B02C 1/10*** | (2006.01) |
| ***B02C 23/02*** | (2006.01) |

(52) U.S. Cl. ..... 241/275; 241/286; 241/300

(58) Field of Classification Search ..... 241/275, 241/286, 300

See application file for complete search history.

(56) References Cited

U.S. PATENT DOCUMENTS 3,606,182 A * 9/1971 Warren ..... 241/275
4,560,113 A 12/1985 Szalanski et al.
4,699,326 A * 10/1987 Warren ..... 241/275
5,029,761 A * 7/1991 Bechler ..... 241/275
5,137,220 A * 8/1992 Rose et al. ..... 241/275
5,533,685 A * 7/1996 Heck ..... 241/275
6,179,234 B1 * 1/2001 Marshall et al. ..... 241/275

FOREIGN PATENT DOCUMENTS

EP 135287 A2 * 3/1985

* cited by examiner

*Primary Examiner*—Bena Miller
(74) *Attorney, Agent, or Firm*—Dinsmore & Shohl LLP

(57) ABSTRACT

An improved vertical shaft impactor rock crusher is provided. The improvement comprises an anvil having a front impact surface, a planar rear surface and a side surface extending between the front and rear surfaces. A shaft extends from the rear surface and can have a polygonal shaped cam lobe at the end of the shaft. When seated in the slot of a hanger bracket, the cam lobe keeps the anvil secured to the bracket while a side of the cam lobe rests on a seating block attached to the bracket to hold the anvil in an indexed position. When the impact surface becomes worn from use in the rock crusher, the anvil can be rotated within the bracket so that the cam lobe rests on an adjacent side thereby presenting an unworn surface to fracture feed rock in the rock crusher.

20 Claims, 10 Drawing Sheets

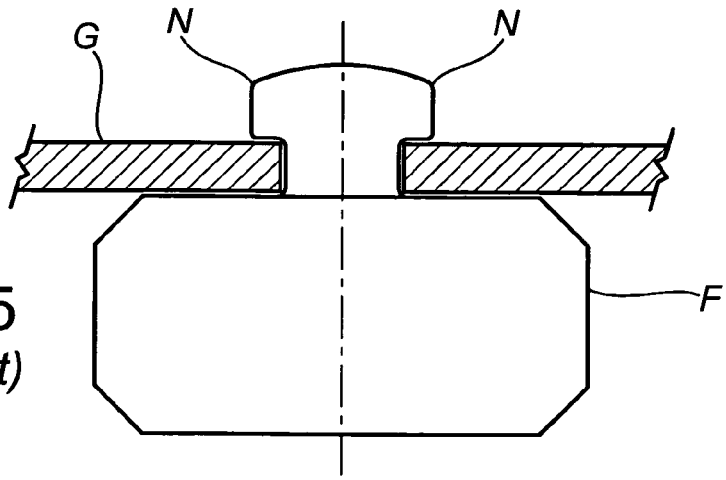
FIG. 5
(Prior Art)
FIG. 6
(Prior Art)
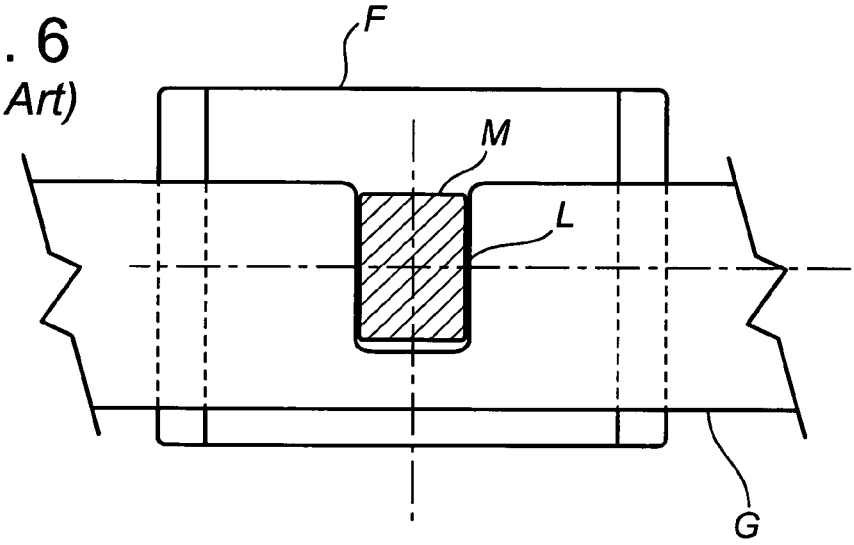
FIG. 7
(Prior Art)
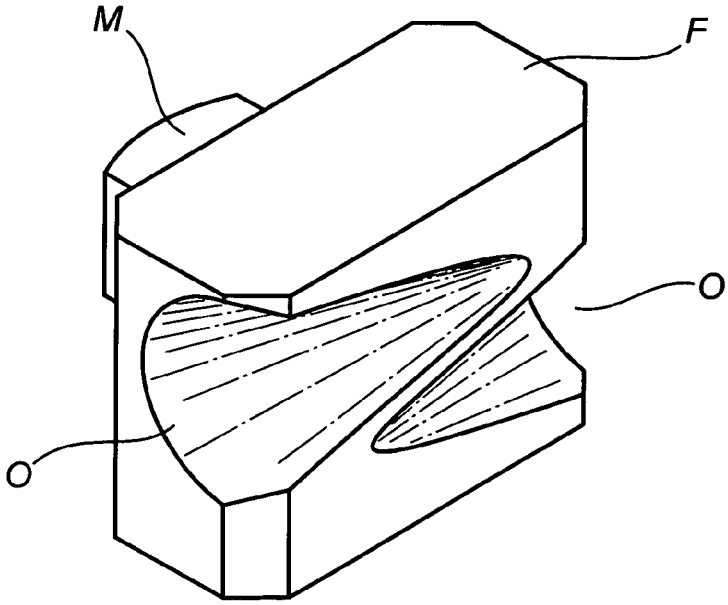

FIG. 10
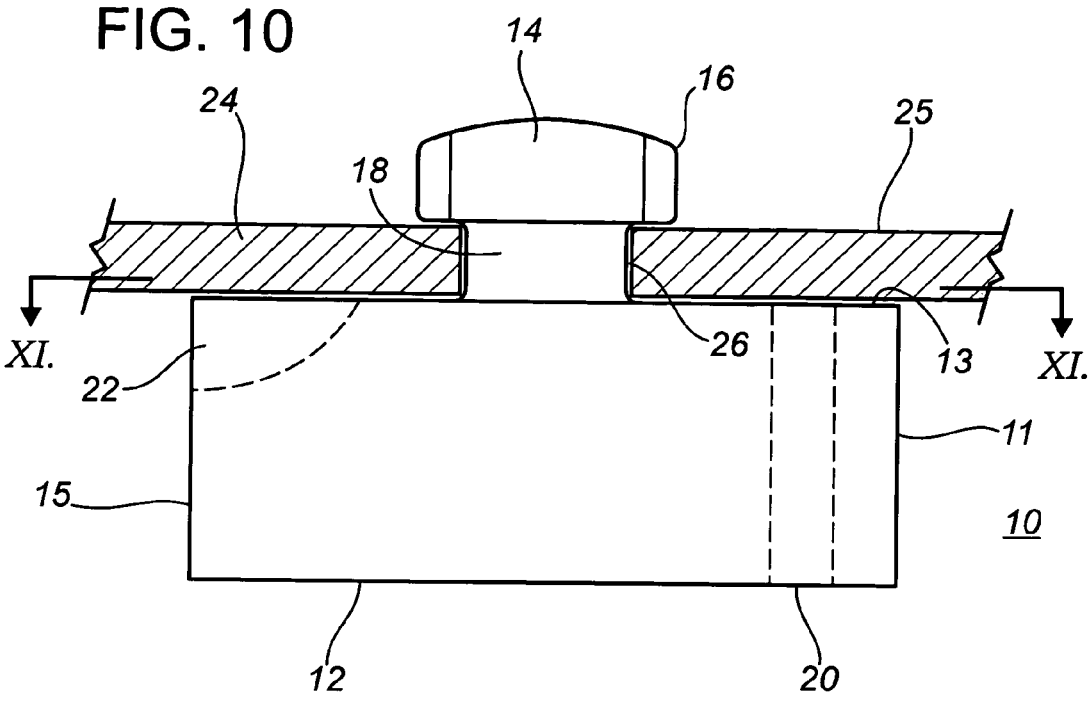
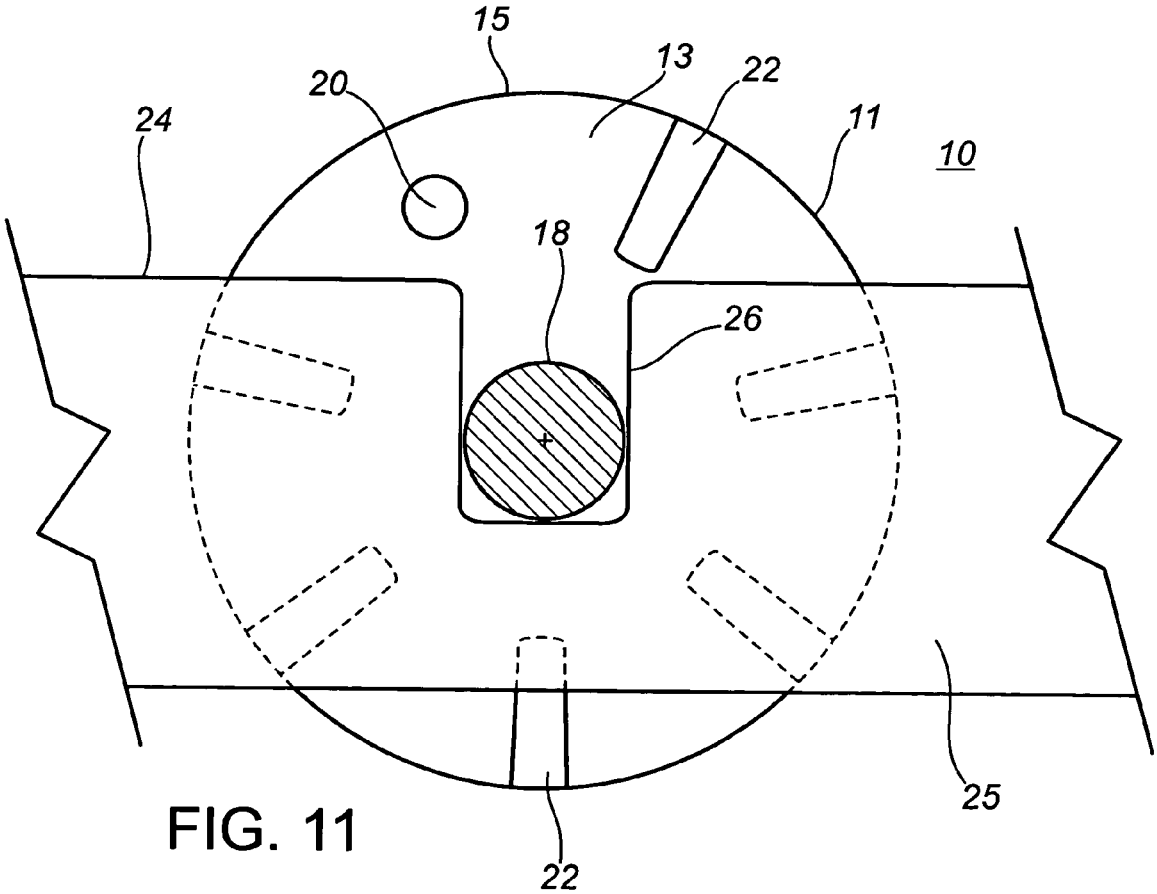
FIG. 11

VERTICAL SHAFT IMPACTOR ROCK CRUSHER

TECHNICAL FIELD

The present invention relates to impactor rock crushing equipment, more specifically, to anvils for use in vertical shaft impactor rock crushers.

BACKGROUND

Impact rock crushing is a method of producing specific aggregates that are able to meet with the higher engineering standards governing newer, more specialized construction projects. It is commonly known in the construction industry that aggregates having four or more clean, fractured surfaces with relatively cubical shape enhance the strength-durability of concrete and asphalt. Aggregates having these qualities mix more thoroughly and provide a finished product having greater compression/elongation strength. An increased number of clean, fractured surfaces on the aggregate enable concrete or asphalt to adhere more completely to the aggregate, enabling improved compaction and stability.

It is known to produce aggregates using eccentric-type rock crushers (also known as cone crushers). This type of rock crusher has been in use for many decades. These machines are very efficient and make up the majority of tertiary rock crushers in use. Cone crushers produce aggregate materials at relatively low cost since they utilize substantially concave and cone shaped mantle castings which provide outstanding wear resistance. These components, made of work hardening manganese steel, typically last several hundred thousand tonnes of crushed product; which could represent many weeks of production before requiring replacement. Cone crushers also have a high rate of production, however, the physical rock shapes they produce tend to be elongated, which reduces the possibility of consistently achieving optimum compression/elongation strength required in specialized batches of concrete or asphalt. Cone crushers wedge the larger feed rock into a controlled-restricted cavity and the wedging forces created fractures the feed rock into smaller sizes. This type of controlled crushing forces the feed rock to crush more elongated, thus producing a greater percentage of finished product that is less than cubical, or for those familiar with this industry, "arrow heads".

It is also known to use impact crushers, more specifically, vertical shaft impactor ("VSI") rock crushers as depicted as "A" in FIG. 1. They are unique in that they produce a crushed aggregate that is not fractured in a confined cavity, but openly fractured by direct impact. VSI rock crushers create a finished product that has multiple clean fractured surfaces and tends to be more cubical since the rock can fracture naturally.

Referring back to FIG. 1, feed rock "C" to be crushed into aggregate "I" is introduced into VSI rock crusher "A" via hopper "B". Feed rock "C" lands on rotating table "D". Table "D" is rotated by shaft "J" having pulley "K". Pulley "K" is driven by a belt and a motor (not shown). Impellers "E" on table "D" throw feed rock "C" towards the outer walls of VSI rock crusher "A" where feed rock "C" strikes anvils "F". Anvils "F" are supported by hanger "G" that are, in turn, secured to bracket ring "H". Table "D" turns at a sufficient speed such that feed rock "C" impacts anvils "F" with sufficient force to cause feed rock "C" to break into smaller pieces that form aggregate "I". The rotational speed of table "D" can exceed 300 RPM, which will generate sufficient impact velocity to feed rock "C". FIG. 2 shows a perspective view of VSI rock crusher "A", table "D", impellers "E", anvils "F", hanger brackets "G" and bracket ring "H".

As effective as VSI rock crushers are in producing "higher spec" aggregates, the wear components utilized, i.e. impellers "E" and anvils "F", are physically smaller as compared to cone crushers. Accordingly, they wear out relatively quickly. Anvils and impellers are, typically, alloy castings that are expensive and may only last one or two production shifts. The higher wear rate of impellers and anvils results in more frequent maintenance of VSI rock crushers, namely, replacing worn out impellers and anvils. Accordingly, impactor crushing can be more expensive than cone crushing. In addition, impellors and anvils are cast items that can weigh over 100 pounds each. The manhandling of these items as they are replaced in VSI rock crushers can be hazardous.

Referring to FIGS. 3 and 4, a typical prior art anvil "F" is shown having integral lug "M" with lug flanges "N". As illustrated, lug "M" is positioned vertically with respect to anvil "F". Flanges "N" are used to secure anvil "F" to hanger bracket "G" as shown in FIGS. 5 and 6. Hanger bracket "G" has slot "L" that is sized to receive lug "M" and to prevent anvil "F" from rotating when seated in hanger bracket "G". Flanges "N" rest on the backside of hanger bracket "G" to keep anvil "F" upright. As shown, lug "M" has a rectangular cross-section. This configuration allows anvil "F" to be placed into bracket "G" in one of two possible positions. Referring to FIG. 7, a typical wear pattern on anvil "F" is illustrated. As feed rock "C" is thrown towards anvils "F" by impellers "E" on table "D", feed rock "C" will cause wear pattern "O" on the impact face of anvils "F". Once wear pattern "O" has approached or reached the maximum permissible wear, anvil "F" can be lifted from bracket "G" rotated 180° and placed back into bracket "G" to present a second wear surface. After the maximum permissible wear has been reached on this second surface, anvil "F" is then replaced with a new anvil.

It is, therefore, desirable to provide an improved vertical shaft impactor rock crusher where the improvement provides anvils that have extended wear characteristics over prior art anvils.

SUMMARY

An improved VSI rock crusher is provided, the improvement being the VSI rock crusher having anvils comprising more than two impact surfaces. In another embodiment, an anvil for use in a VSI rock crusher comprising more than two impact surfaces is provided. In yet another embodiment, a kit for replacing worn-out anvils in a VSI rock crusher is provided, the kit comprising anvils having more than two impact surfaces.

In one embodiment, the anvil can comprise a disk portion having a front impact surface, a rear surface and an edge surface extending between the front and rear surfaces.

In a representative embodiment, the rear surface can be substantially planer. In another embodiment, the anvil comprises a lug having a longitudinal shaft that extends perpendicularly from the rear surface at one end and a cam lobe at the other end. In a representative embodiment, the shaft is substantially perpendicular to the rear surface. In another embodiment, the disk portion can be circular, elliptical or polygon-shaped in cross-section.

In one embodiment, the shaft can be circular in cross-section and can be of dimension such that the anvil can be seated in a typical hanger bracket with minimal planer clearance between the shaft and the hanger bracket slot. In another embodiment, the cam lobe can have a diameter larger than the shaft whereby the cam lobe keeps the anvil upright and securely seated in the hanger bracket.

In yet another embodiment, the cam lobe can have indexing means for setting one of a plurality of rotary positions of the anvil when seated in the hanger bracket. In a representative embodiment, the indexing means comprises the cam lobe having a polygon-shape in a cross-section. At a minimum, the cam lobe can have three sides. In a representative embodiment, the cam lobe can have four to ten sides although it should be obvious to a person skilled in the art that the cam lobe can have more than ten sides.

When the anvil is seated in a hanger bracket, the anvil becomes fully seated when one of the cam lobe sides is resting square or flat on a cam seating block disposed on the rear side of the hanger bracket below the hanger slot. The typical weight of the anvil keeps the anvil in the rested position when the VSI rock crusher is in use. Over time, the anvil will develop a wear pattern on the front impact surface as a result of feed rock being impacted against it. At such time, the anvil can be rotated within the hanger bracket so that the next adjacent side of the cam lobe can rest on the cam seating block. This allows the front impact surface of the disk portion to present an unworn surface to the feed rock introduced into the VSI rock crusher.

In one embodiment, the anvil can comprise at least one indexing slot disposed on the side surface to allow a pry bar or lever to be inserted, like a spoke connected to a hub, to ease the effort required in rotating the anvil within the hanger bracket. Once the anvil is seated into a new position, the pry bar or lever can be removed.

In another embodiment, a kit can be provided for VSI rock crushers that comprises at least one anvil as described above. In a further embodiment, the kit can include at least one cam seating block for attachment to a hanger bracket by welding or such other suitable means as known to a person skilled in the art. In yet another embodiment, the kit can include at least one impeller for the rotation table of a VSI rock crusher. In a further embodiment, an improved VSI rock crusher can be provided, comprising at least one anvil as described above.

Broadly stated, an embodiment of an anvil is provided for use with a vertical shaft impactor rock crusher having at least one anvil hanger bracket for receiving the anvil, the at least one hanger bracket having a cam-seating block, the anvil comprising: a disk portion defining a front impact surface, a substantially planar rear surface and a side surface extending therebetween; a longitudinal shaft having first and second ends defining a longitudinal axis extending therebetween, the first end disposed on the rear surface, the shaft extending away from the rear surface whereby the axis is substantially perpendicular to the rear surface; a cam lobe disposed on the second end of the shaft, the cam lobe having a diameter greater than the diameter of the shaft; and indexing means for setting one of a plurality of positions of the anvil when the anvil is seated in the at least one anvil hanger bracket.

Broadly stated, an embodiment of an improved vertical shaft impactor rock crusher having at least one anvil hanger bracket having a cam-seating block is provided, the improvement comprising at least one anvil seated in the at least one anvil hanger bracket, the at least one anvil comprising: a disk portion defining a front impact surface, a substantially planar rear surface and a side surface extending therebetween; a longitudinal shaft having first and second ends defining a longitudinal axis extending therebetween, the first end disposed on the rear surface, the shaft extending away from the rear surface whereby the axis is substantially perpendicular to the rear surface; a cam lobe disposed on the second end of the shaft, the cam lobe having a diameter greater than the diameter of the shaft; and indexing means for setting one of a plurality of positions of the at least one anvil when the at least one anvil is seated in the at least one anvil hanger bracket.

Broadly stated, an embodiment of an improved vertical shaft impactor rock crusher having at least one anvil hanger bracket having front and rear surfaces and a slot capable of receiving an anvil is provided, the improvement comprising a cam-seating block disposed on the rear surface of the at least one anvil hanger bracket.

Broadly stated, an embodiment of a kit for a vertical shaft impactor rock crusher having at least one anvil hanger bracket capable of receiving an anvil and a rotating table is provided, the kit comprising at least one anvil comprising: a disk portion defining a front impact surface, a substantially planar rear surface and a side surface extending therebetween; a longitudinal shaft having first and second ends defining a longitudinal axis extending therebetween, the first end disposed on the rear surface, the shaft extending away from the rear surface whereby the axis is substantially perpendicular to the rear surface; a cam lobe disposed on the second end of the shaft, the cam lobe having a diameter greater than the diameter of the shaft; and indexing means for setting one of a plurality of positions of the at least one anvil when the at least one anvil is seated in the at least one anvil hanger bracket.

BRIEF DESCRIPTION OF DRAWINGS

FIG. 5 is a top plan sectional view depicting the prior art anvil of FIG. 3 seated in a hanger bracket.

FIG. 6 is a rear elevational section view depicting the prior art anvil of FIG. 3 seated in a hanger bracket.

FIG. 7 is an isometric view depicting the prior art anvil of FIG. 3 with typical wear patterns from being used in the rock crusher of FIG. 1.

FIG. 10 is a top plan section view depicting the anvil of FIG. 8 seated in a hanger bracket.

FIG. 11 is a rear elevational cross-section view along section lines XI-XI depicting the anvil of FIG. 10.

DETAILED DESCRIPTION

Figure 1:
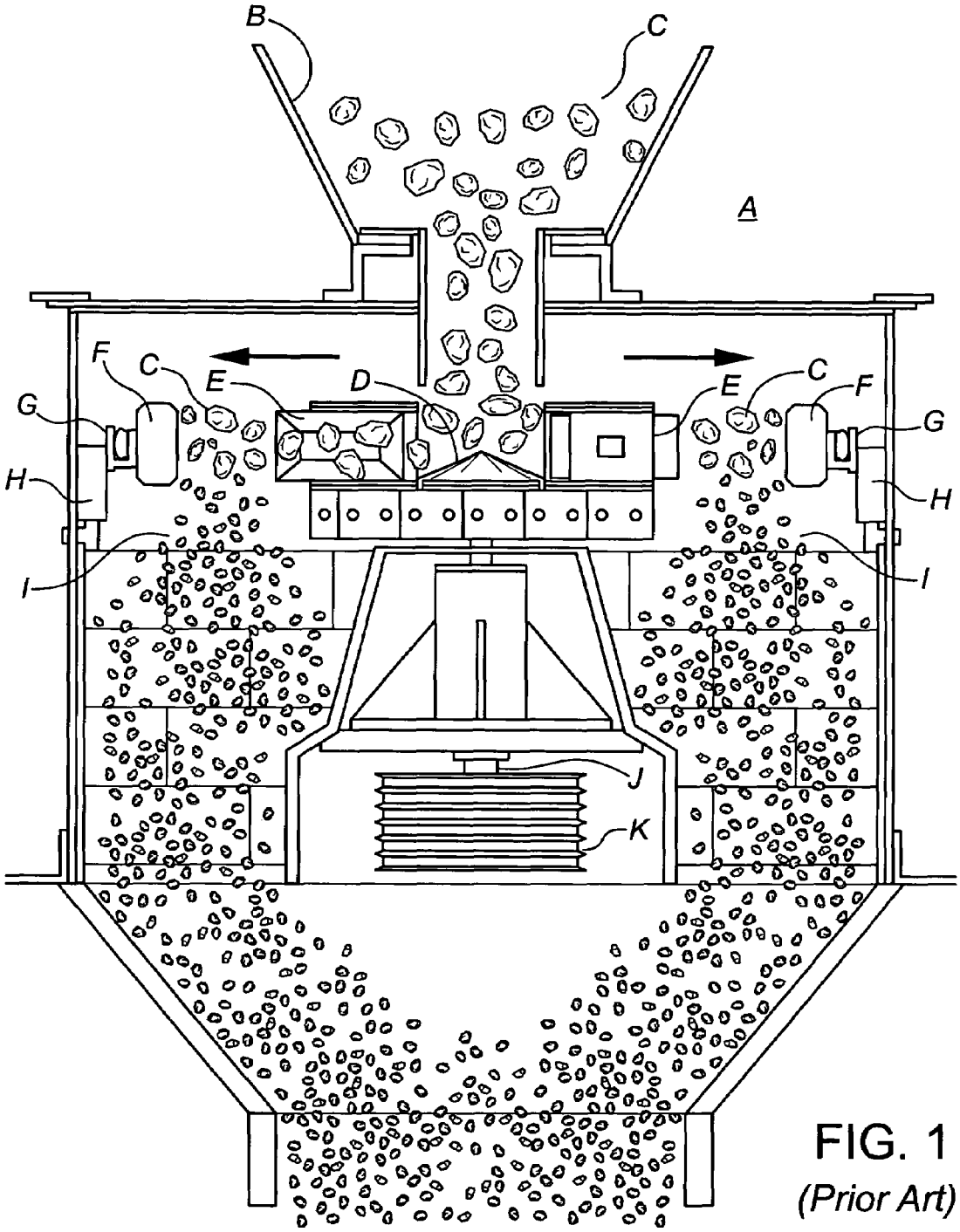
FIG. 1 (Prior Art)
FIG. 1 is a side elevational cross-section view depicting a prior art vertical shaft impactor rock crusher.
Figure 2:
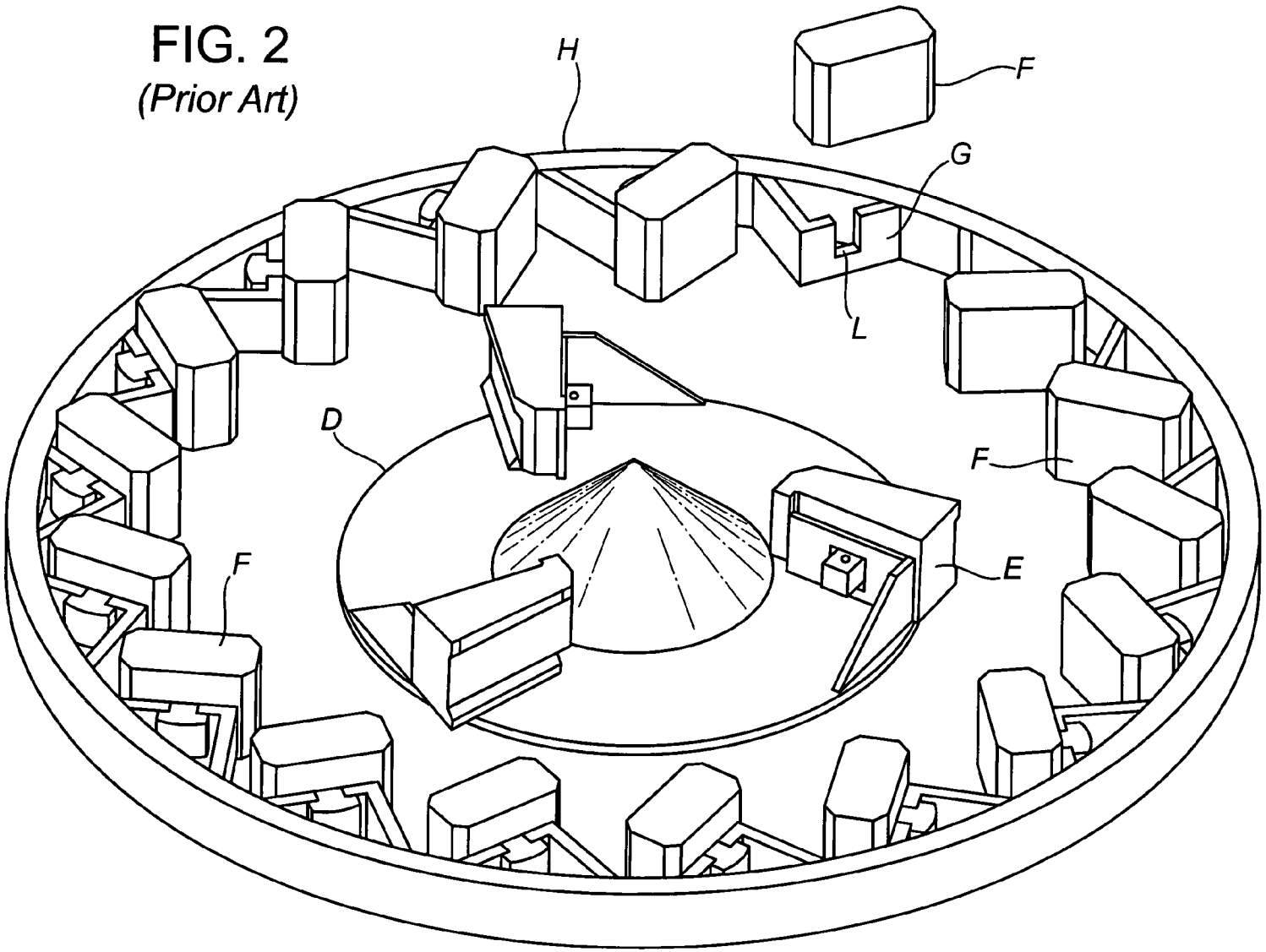
FIG. 2 (Prior Art)
FIG. 2 is an isometric view depicting the internal mechanism of the prior art rock crusher of FIG. 1.
Figure 4:
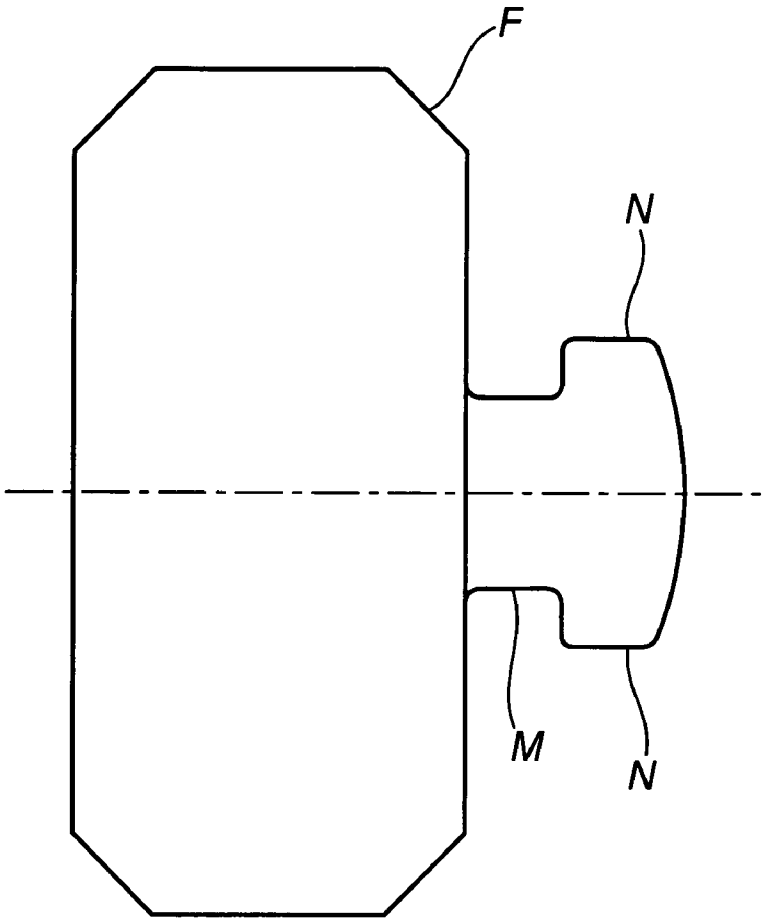
FIG. 4 (Prior Art)
FIG. 4 is a top plan view depicting the prior art anvil of FIG. 3.
Figure 3:
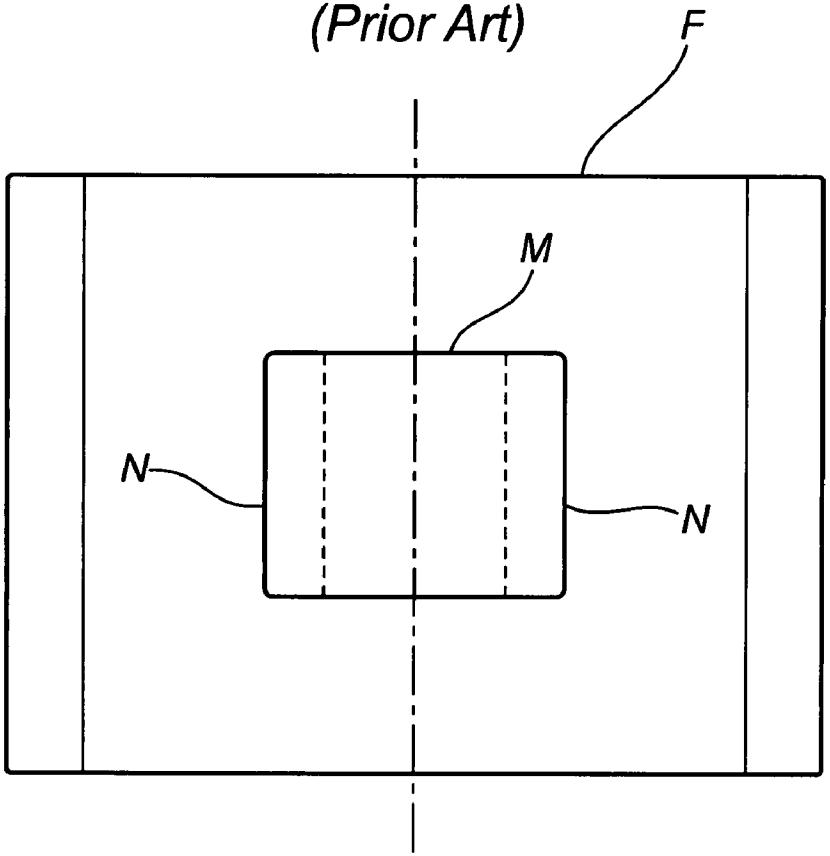
FIG. 3 (Prior Art)
FIG. 3 is a rear elevational view depicting a prior art anvil for the rock crusher of FIG. 1.
Figure 9:
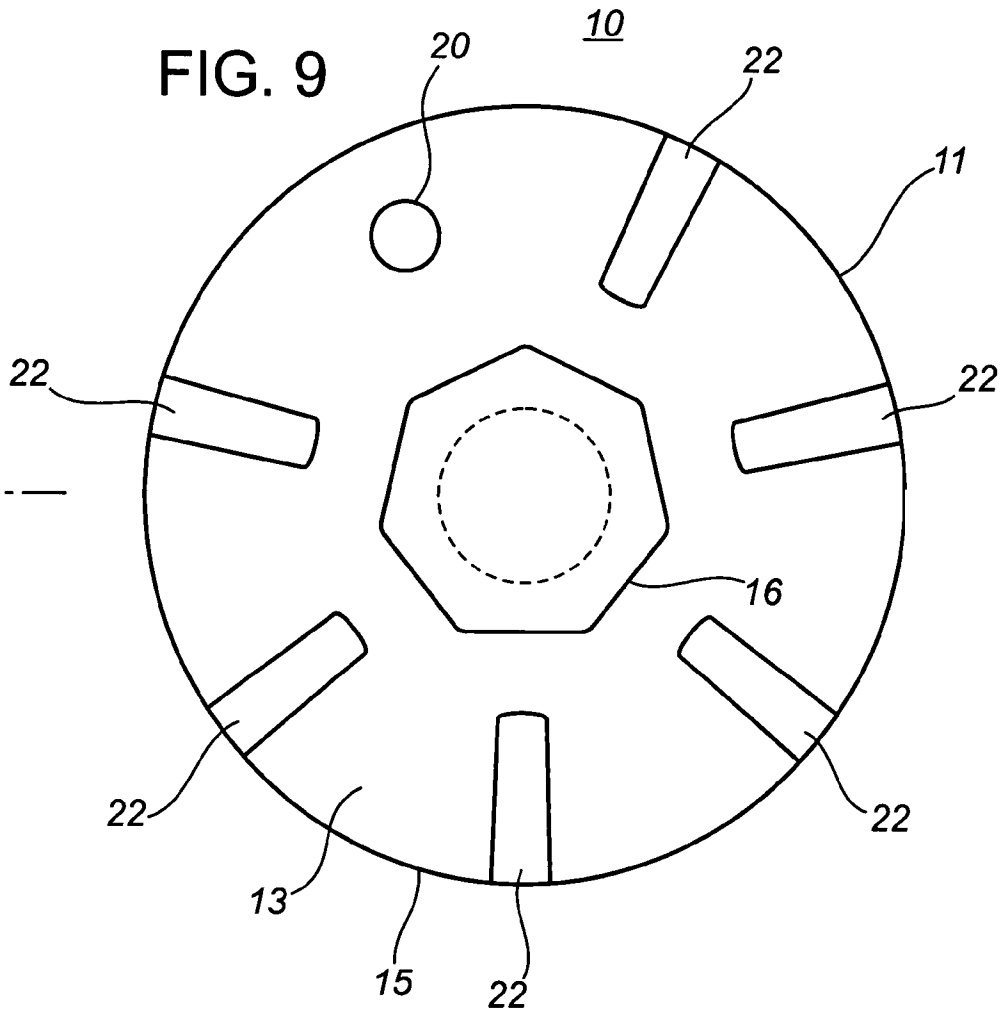
FIG. 9 is a rear elevational view depicting the anvil of FIG. 8.
Figure 8:
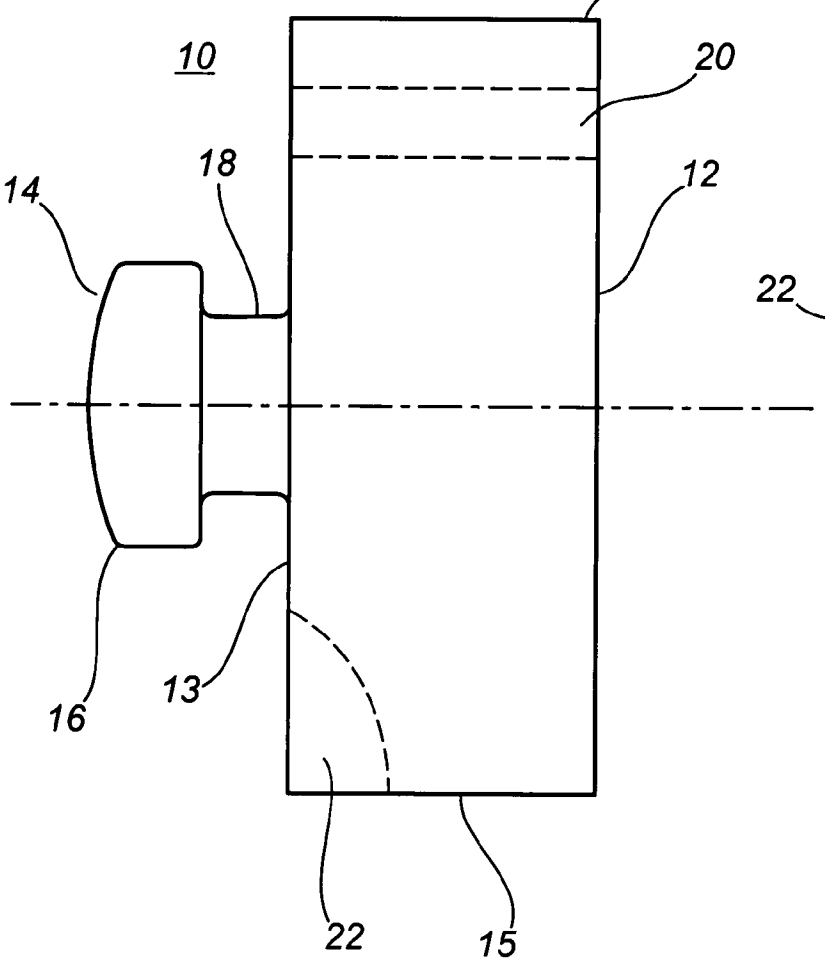
FIG. 8 is a side elevational view depicting an improved anvil for the rock crusher of FIG. 1.

Referring to FIGS. 8 and 9, an embodiment of anvil 10 for use in a VSI rock crusher is shown. In this embodiment, anvil 10 comprises front impact surface 12, rear surface 13 and side surface 15 extending therebetween to form disk portion 11. In one embodiment, disk portion 11 can be circular in cross-section. In other embodiments, disk portion 11 can be elliptical or polygonal-shaped in cross-section. Attached to rear surface 13 is lug 14. In one embodiment, lug 14 comprises shaft 18 and cam lobe 16. In another embodiment, cam lobe 16 has a diameter larger than the diameter of shaft 18. In yet another embodiment, anvil 10 can include lifting hole 20 to facilitate a hook and/or cable for lifting and moving anvil 10. In yet another embodiment, anvil 10 can include at least one indexing slot used for indexing anvil 10 as described in further detail below.

Referring to FIGS. 10 and 11, anvil 10 is shown seating in anvil hanger bracket 24. Hanger bracket 24 can include slot 26 for receiving shaft 18. In one embodiment, slot 26 is sized slightly wider than the width of shaft 18 so that shaft 18 can freely rotate in slot 26 but not wider than the diameter of cam lobe 16. In this manner, cam lobe 16 seats on rear side 25 and keeps anvil 10 from falling away from hanger bracket 24. In another embodiment, rear surface 13 is substantially planar and the length of shaft 18 is chosen so that anvil 10 securely sits in hanger bracket 24 with minimal movement. Shaft 18 can be circular in cross-section although it should be obvious to a person skilled in the art that shaft 18 can have any cross-sectional shape that can freely turn in slot 26.

Figure 12:
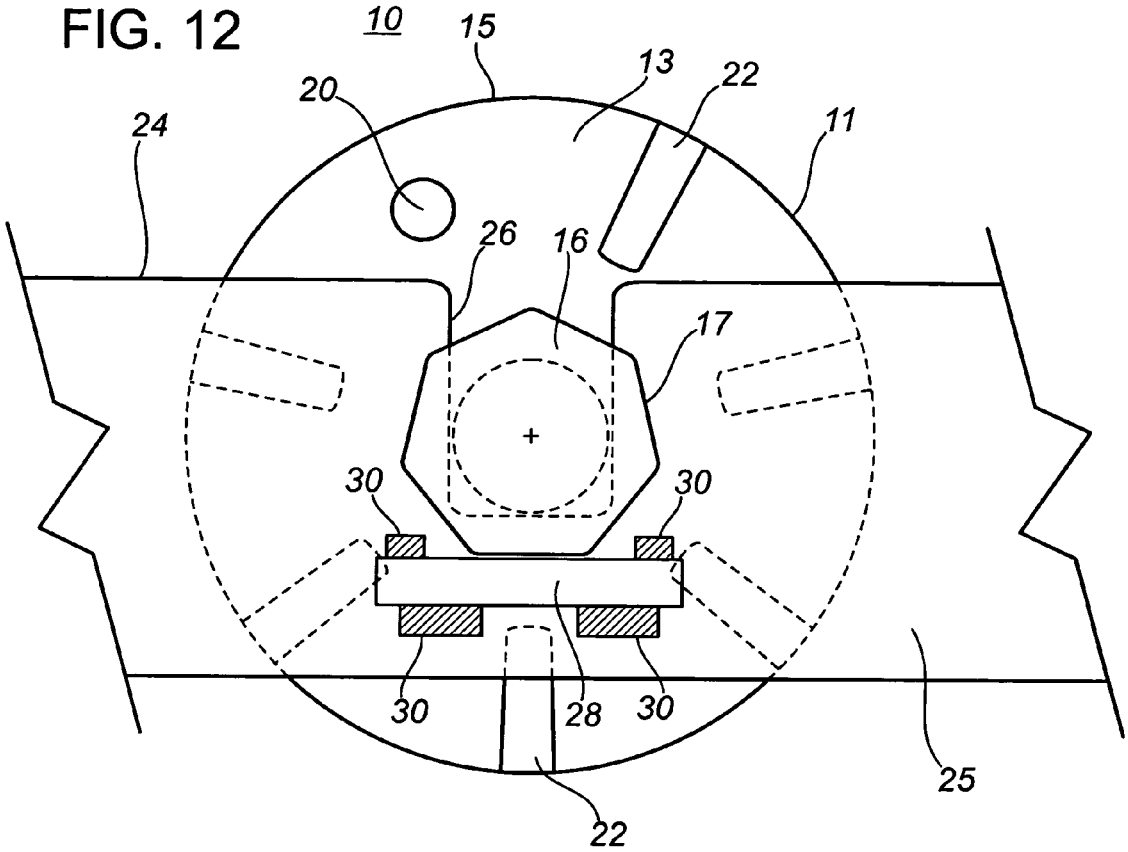
FIG. 12 is a rear elevational section view of the anvil of FIG. 10.
Figure 13:
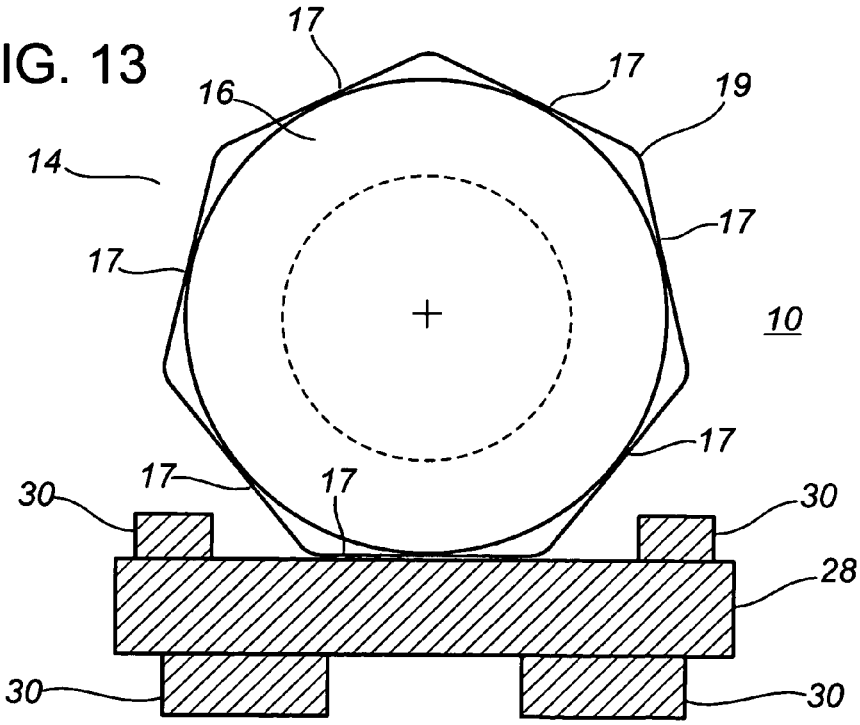
FIG. 13 is a rear close-up view depicting the cam lobe of the anvil of FIG. 12 resting on a cam seating block.

Referring to FIGS. 12 and 13, anvil 10 is shown seated in hanger bracket 24 with cam lobe 16 seated on cam seating block 28 to illustrate how anvil 10 can be rotated or "indexed" in hanger bracket 24. Anvil 10 comprises indexing means that comprises at least three sides disposed on cam lobe 16. In the illustrated embodiment, cam lobe 16 is shown having seven sides, each side labeled as 17. It should be obvious to a person skilled in the art that cam lobe 16 can have any polygonal shape in cross-section. Accordingly, cam lobe 16 can have a minimum of 3 sides up to any number of sides. Cam seating block 28 is positioned beneath slot 26 on rear side 25 of hanger bracket 24. In the illustrated embodiment, cam seating block 28 is attached to hanger bracket 24 by welds 30 although it should be obvious that any suitable attachment means such as bolts, screws, rivets and the like can be used as well. When anvil 10 is seated in hanger bracket 24, one side 17 of cam lobe 16 can sit square or flat on cam seating block 28 and prevents uncontrolled rotation of anvil 10 in slot 26. The weight of anvil 10, which can be 100 pounds or more, ensures that side 17 stays seated on cam seating block 28. Each side 17 represents one indexed position of anvil 10 when seated in hanger bracket 24.

Figure 14:
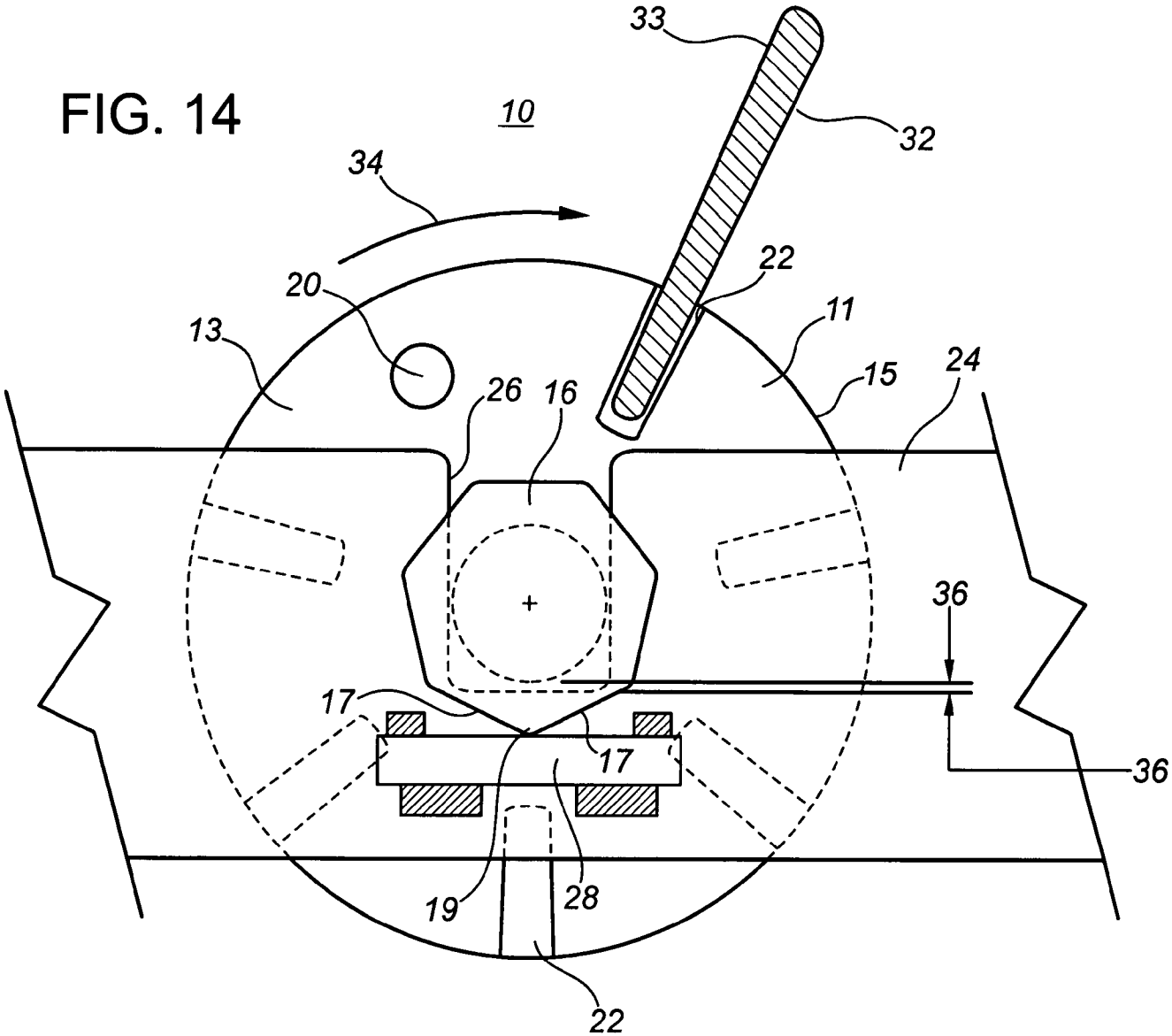
FIG. 14 is a rear elevational view of the anvil of FIG. 12 being rotated with a pry bar.

In FIG. 14, anvil 10 is shown being moved from one indexed position to another. In one embodiment, lever 32 is inserted in one of the plurality of indexing slots 22. Force 33 is applied to lever 32 to move anvil 10 in direction 34. In doing so, cam lobe 16 rotates on cam seating block 28 from one side 17 over lug corner 19 to come to rest on an adjacent side 17. Lug corners 19 prevent free rotation of anvil 10 in slot 26 when lever 32 is removed from indexing slot 22. As anvil 10 is rotated within slot 26, shaft 18 rises within slot 26 by offset displacement 36 and then descends after anvil 10 has been moved to the next indexed position. In this fashion, anvil 10 has a number of indexed positions within hanger bracket 24. When front surface 12 becomes sufficiently worn in one indexed position from fracturing feed rock into aggregate, anvil 10 can then be moved to the next indexed position to present a fresh surface for fracturing feed rock until it, too, becomes sufficiently worn. Accordingly, anvil 10 has a number of wear surfaces on front surface 12, the number being equal to the number of sides 17 on cam lobe 16.

Figure 16:
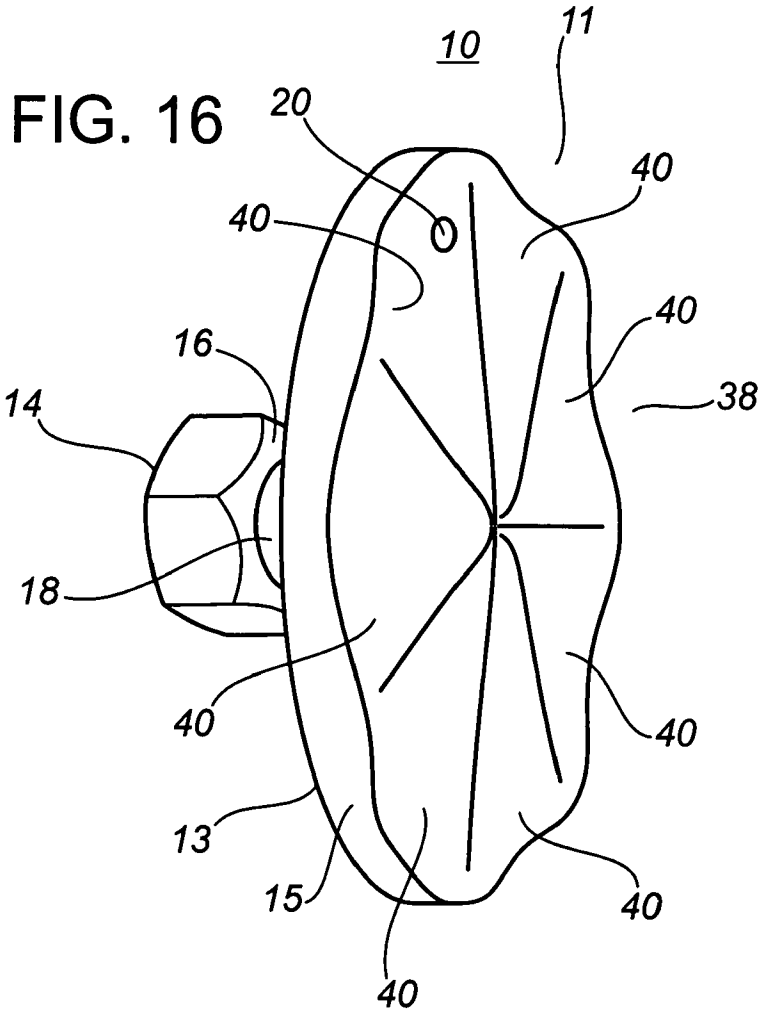
FIG. 16 is an isometric view depicting the anvil of FIG. 15.
Figure 15:
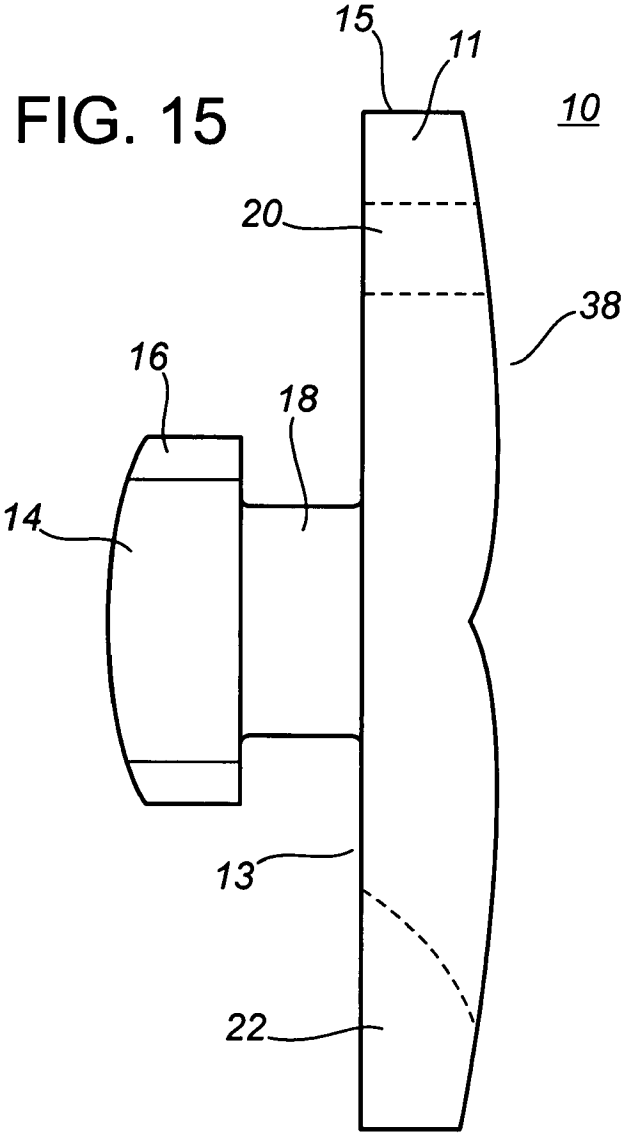
FIG. 15 is a top plan view of the anvil of FIG. 8 with wear patterns.
Figure 17:
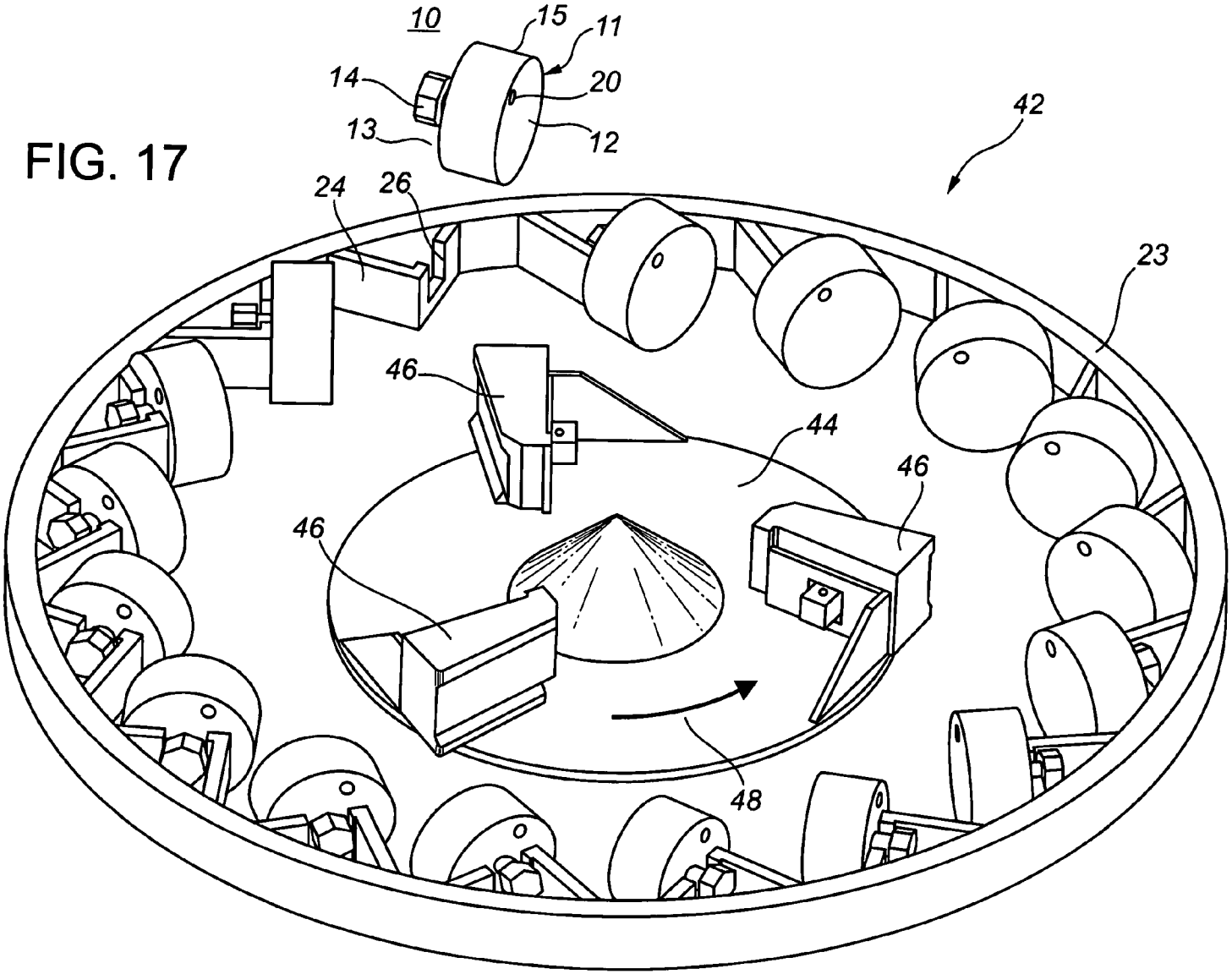
FIG. 17 is an isometric view of the internal mechanisms of a VSI rock crusher fitted with the anvils of FIG. 8.

In FIGS. 15 and 16, anvil 10 is shown after it has been used in all of its indexed positions. Worn impact surface 38 is shown having a number of wear grooves 40, one for each indexed position of anvil 10. When anvil 10 has a number of indexed positions, the wear grooves 40 can overlap thereby enabling more usage of the mass of disk portion 11 for fracturing feed rock. When anvil 10 becomes worn as shown in FIGS. 15 and 16, anvil 10 can be replaced. A hook or cable (not shown) can be inserted in lifting hole 20 to remove worn anvil 10 from hanger bracket 24 and be replaced with a new one. In FIG. 17, rock crusher 42 is shown having bracket ring 23, a plurality of hanger brackets 24 with slots 26, a plurality of anvils 10 seated in hanger brackets 24 and rotating table 44 with impellers 46. As rotating table 44 rotates in direction 48, impellers 46 fling feed rock towards anvils 10 that fracture on impact with anvils 10 to produce aggregate. Impellers 46, like anvils 10, can wear out during usage and will need to be replaced periodically.

In one embodiment, a kit can be provided for rock crusher 42 to facilitate necessary maintenance in replacing worn out components such as anvils and impellers. The kit can include at least one anvil 10 to replace worn out anvils. In another embodiment, the kit can include at least cam one seating block for attaching to the hanger bracket of an existing VSI rock crusher along with at least one anvil 10 so that anvil 10 can be installed in the hanger bracket. In yet another embodiment, the kit can include at least one impeller 46 along with at least one anvil 10 to replace worn anvils and impellers in rock crusher 42. In a further embodiment, a VSI rock crusher can be provided including at least one anvil 10 as described herein and illustrated in FIGS. 8-17.

Although a few illustrative embodiments have been shown and described, those skilled in the art will appreciate that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

What is claimed is:

1. An anvil for use with a vertical shaft impactor rock crusher, the rock crusher having at least one anvil hanger bracket for receiving the anvil, the at least one hanger bracket further having a cam-seating block, wherein the anvil comprises:

a) a disk portion having a cross-sectional shape, the disk portion further comprising a front impact surface, a substantially planar rear surface and a side surface extending therebetween;

b) a longitudinal shaft having first and second ends defining a longitudinal axis extending therebetween, the first end disposed on the rear surface, the shaft extending away from the rear surface whereby the axis is substantially perpendicular to the rear surface;

c) a cam lobe disposed on the second end of the shaft, the cam lobe having a diameter greater than the diameter of the shaft;

d) indexing means disposed on the cam lobe for setting one of a plurality of positions of the anvil when the anvil is seated in the at least one anvil hanger bracket; and e) at least one indexing slot disposed on the side surface, whereby the anvil can be rotated by inserting a lever into the at least one indexing slot and applying force to the lever.

2. The anvil as set forth in claim 1 wherein the cross-sectional shape of the disk portion is circular, elliptical or polygonal.

3. The anvil as set forth in claim 1 wherein the indexing means further comprises at least three sides disposed on the cam lobe, each of the at least three sides capable of resting on the cam-seating block when the anvil is installed in the hanger bracket.

4. The anvil as set forth in claim 3 wherein the indexing means comprises between 3 and 10 sides.

5. An improved vertical shaft impactor rock crusher having at least one anvil hanger bracket further having a cam-seating block, the improvement comprising at least one anvil seated in the at least one anvil hanger bracket, wherein the at least one anvil comprises:

a) a disk portion having a cross-sectional shape, the disk portion further comprising a front impact surface, a substantially planar rear surface and a side surface extending therebetween;

b) a longitudinal shaft having first and second ends defining a longitudinal axis extending therebetween, the first end disposed on the rear surface, the shaft extending away from the rear surface whereby the axis is substantially perpendicular to the rear surface;

c) a cam lobe disposed on the second end of the shaft, the cam lobe having a diameter greater than the diameter of the shaft;

d) indexing means disposed on the cam lobe for setting one of a plurality of positions of the at least one anvil when the at least one anvil is seated in the at least one anvil hanger bracket; and e) at least one indexing slot disposed on the side surface, whereby the anvil can be rotated by inserting a lever into the at least one indexing slot and applying force to the lever.

6. The rock crusher as set forth in claim 5 wherein the cross-sectional shape of the disk portion is circular, elliptical or polygonal.

7. The rock crusher as set forth in claim 5 wherein the indexing means further comprises at least three sides disposed on the cam lobe, each of the at least three sides capable of resting on the cam-seating block when the anvil is installed in the hanger bracket.

8. The rock crusher as set forth in claim 7 wherein the indexing means comprises between 3 and 10 sides.

9. A kit for a vertical shaft impactor rock crusher having at least one anvil hanger bracket and a rotating table, the kit comprising at least one anvil comprising:

a) a disk portion having a cross-sectional shape, the disk portion further comprising a front impact surface, a substantially planar rear surface and a side surface extending therebetween;

b) a longitudinal shaft having first and second ends defining a longitudinal axis extending therebetween, the first end disposed on the rear surface, the shaft extending away from the rear surface whereby the axis is substantially perpendicular to the rear surface;

c) a cam lobe disposed on the second end of the shaft, the cam lobe having a diameter greater than the diameter of the shaft;

d) indexing means disposed on the cam lobe for setting one of a plurality of positions of the at least one anvil when the at least one anvil is seated in the at least one anvil hanger bracket; and e) at least one indexing slot disposed on the side surface, whereby the anvil can be rotated by inserting a lever into the at least one indexing slot and applying force to the lever.

10. The kit as set forth in claim 9 wherein the cross-sectional shape of the disk portion is circular, elliptical or polygonal.

11. The kit as set forth in claim 9 wherein the indexing means further comprises at least three sides disposed on the cam lobe.

12. The kit as set forth in claim 11 wherein the indexing means comprises between 3 and 10 sides.

13. The kit as set forth in claim 9 further comprising at least one cam-seating block for attaching to the at least one anvil hanger bracket.

14. The kit as set forth in claim 13 wherein the indexing means further comprises at least three sides disposed on the cam lobe, each of the at least three sides capable of resting on the cam-seating block when the anvil is installed in the hanger bracket.

15. The kit as set forth in claim 14 wherein the indexing means comprises between 3 and 10 sides.

16. The kit as set forth in claim 9 further comprising at least one impeller.

17. An improved vertical shaft impactor rock crusher having at least one anvil hanger bracket having front and rear surfaces and a slot capable of receiving an anvil, the improvement comprising:

a) a cam-seating block disposed on the rear surface of the at least one anvil hanger bracket; and b) at least one anvil seated in the at least anvil hanger bracket, the at least one anvil comprising:

i) a disk portion having a cross-sectional shape, the disk portion further comprising a front impact surface, a substantially planar rear surface and a side surface extending therebetween, ii) a longitudinal shaft having first and second ends defining a longitudinal axis extending therebetween, the first end disposed on the rear surface, the shaft extending away from the rear surface whereby the axis is substantially perpendicular to the rear surface, iii) a cam lobe disposed on the second end of the shaft, the cam lobe having a diameter greater than the diameter of the shaft, iv) indexing means disposed on the cam lobe for setting one of a plurality of positions of the at least one anvil when the at least one anvil is seated in the at least one anvil hanger bracket, and v) at least one indexing slot disposed on the side surface, whereby the anvil can be rotated by inserting a lever into the at least one indexing slot and applying force to the lever.

18. The rock crusher as set forth in claim 17 wherein the cross-sectional shape of the disk portion is circular, elliptical or polygonal.

19. The rock crusher as set forth in claim 17 wherein the indexing means further comprises at least three sides disposed on the cam lobe, each of the at least three sides capable of resting on the cam-seating block when the anvil is installed in the hanger bracket.

20. The rock crusher as set forth in claim 19 wherein the indexing means comprises between 3 and 10 sides.

* * * * *